United States Patent [19]

Morrison

[11] Patent Number: 4,693,071

[45] Date of Patent: Sep. 15, 1987

[54] VACUUM TEXTURIZING PROCESS

[75] Inventor: Elbert F. Morrison, Clarksville, Va.

[73] Assignee: Burlington Industries, Inc., Greensboro, N.C.

[21] Appl. No.: 811,747

[22] Filed: Dec. 20, 1985

[51] Int. Cl.[4] ..... D02G 1/02; D02G 1/04; D02G 1/16

[52] U.S. Cl. ..... 57/289; 28/271; 57/284; 57/328; 57/333

[58] Field of Search ..... 57/284, 289, 333, 328, 57/246, 247; 28/271-276, 247

[56] References Cited

U.S. PATENT DOCUMENTS

| | | | |
|---|---|---|---|
| 3,204,396 | 9/1965 | Foster et al. | 57/289 |
| 3,217,482 | 11/1965 | Baer | 57/289 X |
| 3,457,610 | 7/1969 | Williams et al. | 57/309 X |
| 3,747,318 | 7/1973 | Cochran | 57/289 X |
| 3,956,878 | 5/1976 | Schaffer et al. | 57/289 X |
| 4,016,626 | 4/1977 | Guillermin et al. | 19/0.46 |
| 4,016,715 | 4/1977 | London, Jr. | 57/289 X |
| 4,118,843 | 10/1978 | Schippers et al. | 28/255 |
| 4,280,260 | 7/1981 | Martin et al. | 28/255 |
| 4,322,944 | 4/1982 | Sraitr et al. | 57/328 |
| 4,356,604 | 11/1982 | Martin et al. | 28/255 |
| 4,424,614 | 1/1984 | Martin et al. | 28/255 |

*Primary Examiner*—John Petrakes
*Attorney, Agent, or Firm*—Nixon & Vanderhye

[57] ABSTRACT

Positive twist control and a gentle action on the yarn are provided by a vacuum texturizing process for yarn. Single filament and multi-filament yarns can be processed, including fine denier filaments and/or weak thermoplastic filaments. Yarn is fed by feed rolls to a heater block and then to the generally axially through-extending passageway and a spindle perforated cylinder. The spindle is mounted for rotation about an axis, and is rotated at a speed of several hundred thousand rpm, while a vacuum in the range of about 8-12 inches of mercury is applied to the exterior of the cylinder. The force of the vacuum holds the yarn against the interior wall of the passageway so that each rotation of the cylinder causes a twist of the yarn, which is backed up to the heater and set in a semi-permanent, false twist configuration. The yarn is withdrawn from the cylinder by output means, at which time the twist relieves itself and a textured, bulk, stretch-type yarn is produced.

17 Claims, 7 Drawing Figures

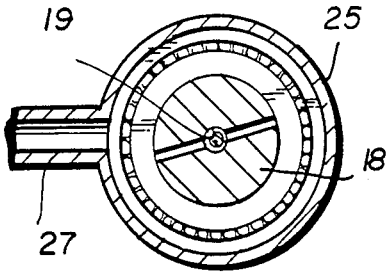
FIG. 2
FIG. 3
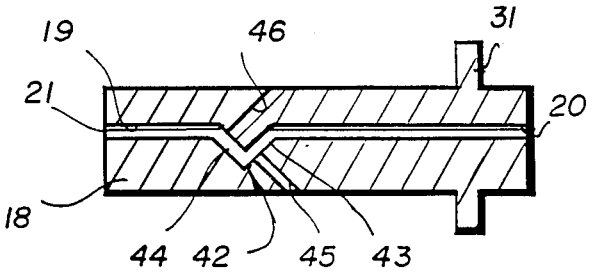
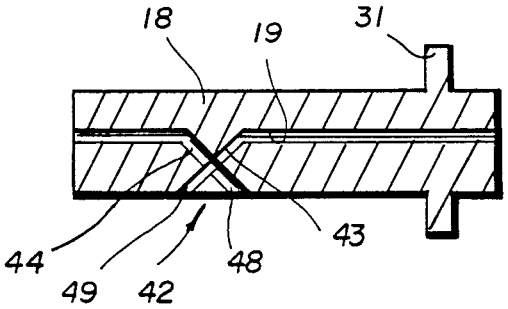
FIG. 4
FIG. 5
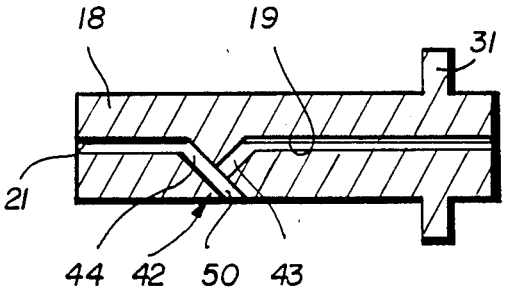
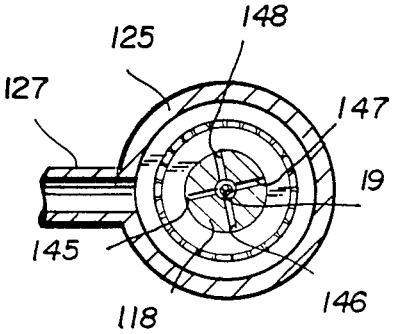
FIG. 7

VACUUM TEXTURIZING PROCESS

BACKGROUND AND SUMMARY OF THE INVENTION

Conventional procedures for using textured yarns include pin twisting and friction twisting. In such procedures, problems may result including broken filaments. Further, in such procedures, there is not as much positive twist control as desired, the fiber finish often leaves something to be desired, the bulk of the textured yarn may be less than desirable, and there is a capacity for only applying a limited number of turns per inch. Also there are some fine denier filaments and weaker thermoplastic filaments (e.g., Arnel) which cannot be processed thereby.

According to the present invention, a new texturizing process is provided, utilizing particular apparatus, which overcomes a number of the problems inherent in prior art texturizing procedures. According to the present invention, better positive twist control is provided than is possible in the prior art conventional procedures, and the yarn is handled in a more gentle manner. This allows textured bulk, stretch-type yarn to be produced even from fine denier filaments and from weaker thermoplastic filaments, that could not be processed utilizing conventional techniques.

According to one aspect of the present invention, a yarn texturizing apparatus is provided. The conventional components of the apparatus include a feed means, a heater block, and output means. According to the invention, disposed between the heater block and the output means is a spindle comprising a perforated cylinder having a generally axially through-extending passageway, means for mounting the cylinder for rotation about an axis coincident with the passageway, means for rotating the cylinder, a source of vacuum, and means for connecting the vacuum to the exterior of the cylinder. The heater is generally in-line with the cylinder passageway, and the cylinder passageway may have a number of configurations and cooperative features with perforations, such as a V-shaped offset portion. The mounting means preferably comprises a mounting tube having interior dimensions significantly greater than the exterior dimensions of the perforated cylinder, the tube connected through a passageway to the vaccum, and the bearing means being provided between the tube and the cylinder. The entering portion of the cylinder passageway is preferably circular in cross-section and has a diameter approximately twice as great as the diameter of a single filament yarn (or composite diameter of a multi-filament yarn) fed into it, while the exit portion of the passageway from the cylinder has a diameter of about 1.5 times the diameter of the exiting yarn.

According to another aspect of the present invention, a method of texturizing a yarn is provided, which method utilizes a heater block, a spindle including a perforated cylinder with a generally axially through-extending passageway, and a source of vacuum. The method comprises the following steps: (a) Feeding yarn to be texturized through the heater block, in operative contact therewith, to the perforated cylinder generally axially extending passageway. (b) Imparting twist to the yarn in the cylinder, which twist is backed up to the heater block wherein the twist is set in a semi-permanent, false twist configuration; and (c) Removing the yarn from the cylinder at which time the twist relieves itself and a textured, bulk, stretch-type yarn is produced. Step (b) is practiced by rotating the cylinder while applying vacuum to the exterior thereof so that the yarn is held by the force of the vacuum against the inner wall of the cylinder, and the rotation of the cylinder imparts twist to the yarn. The rotation typically is at a speed of several hundred thousand rpm, while the applied vacuum is in the range of about 8–12 inches of mercury.

Also according to the present invention, it is possible to produce a textured, bulk, stretch-type yarn from fine denier filaments and/or weak thermoplastic filaments, such filaments being so fine and/or weak that they normally are not capable of being texturized using conventional pin twisting and friction twisting processes.

It is the primary object of the present invention to provide for the production of textured, bulk, stretch-type yarn, planned positive twist control, and the application of a gentle action to the yarn during production. This and other objects of the invention will become clear from an inspection of the detailed description of the invention and from the appended claims.

BRIEF DESCRIPTION OF THE DRAWINGS

FIG. 2 is a top cross-sectional view of the vacuum spindle assembly of FIG. 1, taken along lines 2—2 thereof;

FIG. 3 is a longitudinal cross-sectional detail view of the spindle of FIGS. 1 and 2;

FIG. 4 is a longitudinal cross-sectional view of another exemplary form of spindle utilizable in the apparatus of FIG. 1;

FIG. 5 is a longitudinal cross-sectional of yet another form of exemplary spindle utilizable in the apparatus of FIG. 1;

FIG. 7 is a top cross-sectional detail view of the spindle of FIG. 6, taken along lines 7—7 thereof.

DETAILED DESCRIPTION OF THE DRAWINGS

Figure 1:
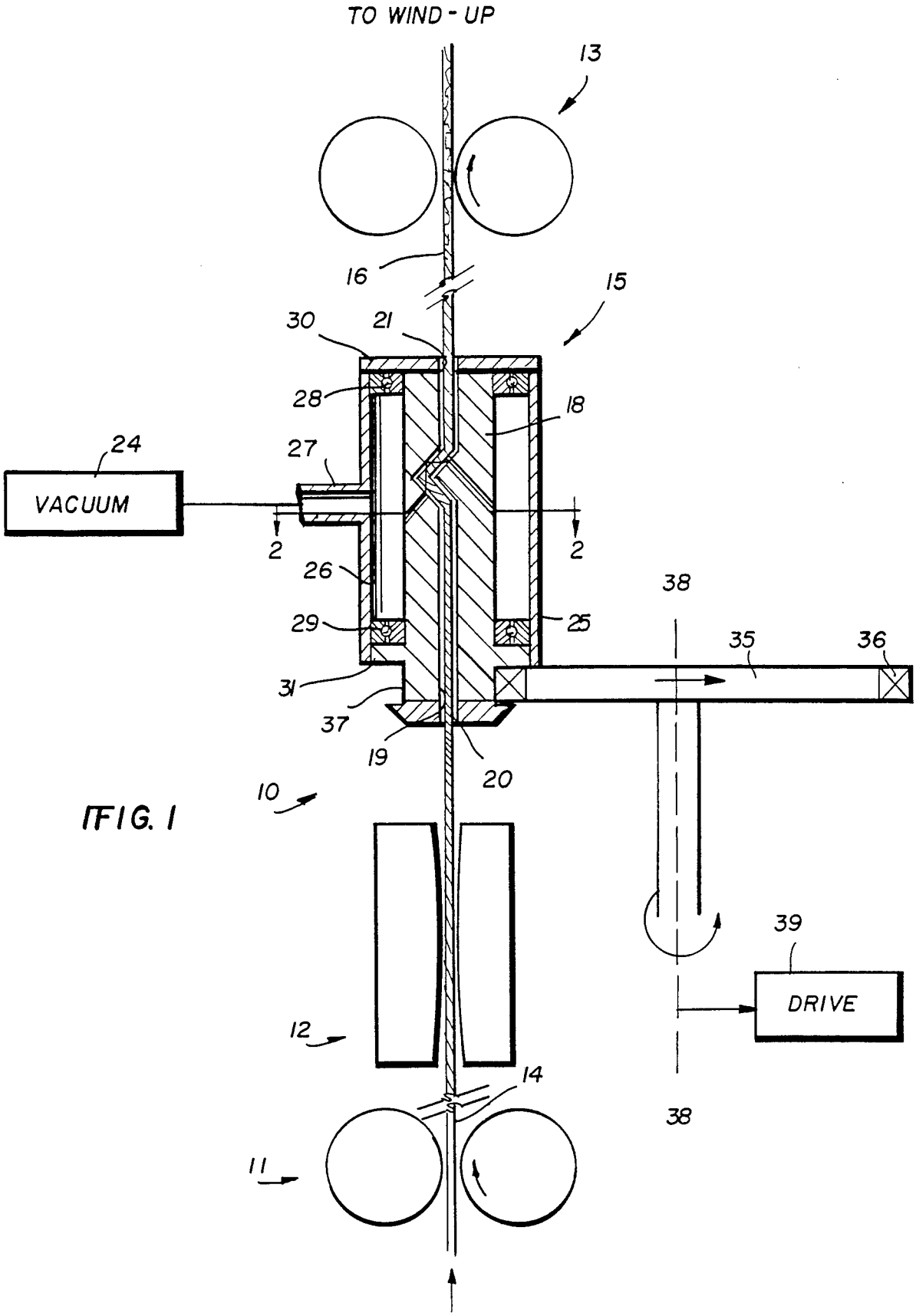
FIG. 1 is a longitudinal view, partly in cross-section and partly in elevation, of exemplary apparatus according to the present invention.

Exemplary apparatus according to the present invention is shown generally by reference numeral 10 in FIG. 1. Conventional components of the apparatus 10 include the yarn feed means 11, which preferably comprises a pair of input feed rolls, a conventional heater block 12, and conventional output means 13, such as a pair of output feed rolls. Conventional single filament or multi-filament yarn 14 is fed by feed means 11 through heater block 12 to a spindle assembly 15 according to the present invention, and bulk, textured yarn 16 is removed from the spindle assembly 15.

The spindle assembly 15 according to the present invention comprises a perforated cylinder 18 having a generally axially through-extending passageway 19 therein. The passageway 19 has an inlet opening 20 at an end of the cylinder 18 closest to the heater block 12, and an outlet 21 at the end thereof most remote from the heater block 12. As illustrated in the drawings, preferably the interior passageway of the heater block 12 is in-line with the passageway 19. Also as illustrated in FIG. 1, the spindle assembly 15 will normally be vertically above the heater block 12, although a wide variety of other orientations also may be utilized.

The cylinder 18 is mounted for rotation about an axis generally coincident with the passageway 19 (that is, extending through the inlet 20 and outlet 21). A source of vacuum 24 is also provided, as well as means for connecting the exterior of the cylinder 18 to the vacuum. In the embodiment illustrated in FIG. 1, the means for mounting the cylinder for rotation and the means for connecting the exterior of the cylinder 18 to the vacuum 24 comprise the mounting tube 25 which has an interior surface 26 thereof radially spaced from the exterior surface of the cylinder 18, and has a passageway 27 extending generally radially therefrom which is connected up to the vacuum source 24. Bearing means 28, 29 engage the interior surface 26 of the tube 25, and the exterior of the cylinder 18, to provide for rotation of the cylinder 18. The bearings also provide some sealing action, including by cooperating with the top portion 30 of the tube 25, and the flange disc 31 of the cylinder 18.

For most effective operation, it is desirable to make the inlet 20 generally circular in cross-section, with a diameter of approximately twice the diameter of the yarn 14 (or the composite diameter of the yarn 14 if it is a multi-filament yarn), and to make the outlet 21 with a diameter which is approximately 1.5 times the diameter of the textured yarn 16 produced.

The apparatus 10 also comprises means for rotating the cylinder 18 about its axis. While a wide variety of such means may be employed, a particularly advantageous means illustrated in the drawings comprises a friction disc 35 which has a friction drive surface 36 thereof that is in spring or clutch contact with the surface 37 of the cylinder 18, which is a drive surface thereof. In the FIG. 1 embodiment, the surface 37 is below the flange disc 31, and exterior of the tube 25. Friction disc 35 is rotated about an axis 38—38 which is parallel to, and horizontally spaced from, the axis of rotation of the cylinder 18. Any suitable drive mechanism 39 may be provided for rotating the disc 35 about its axis 38—38, such as an electric motor. In one typical exemplary form of the invention, the disc 35 has an 8-inch diameter while the drive portion 37 of the spindle 18 has a 1.25-inch diameter and the disc is rotated at 25,000 rpm. This effects rotation of the spindle 18 at 800,000 rpm. It is desirable that the speed of rotation of the cylinder 18 be on the order of several thousand rpm.

The cylinder 18 can have a wide variety of forms. Exemplary forms can be seen most clearly in FIGS. 3 through 5. The cylinder 18 of FIG. 3 is the same cylinder as is illustrated in FIGS. 1 and 2. The passageway 19 of the cylinder 18 includes a generally V-shaped offset portion indicated generally by reference numeral 42, and including a first leg 43 and a second leg 44. The perforations of the cylinder 18 in this embodiment include a first perforation 45 which is in operative communication with the leg 43 and slants through the cylinder 18 toward the inlet opening end 20 thereof, and a perforation 46 which cooperates with the leg 44 and also slants in the general direction of the inlet 20 end of the cylinder 18.

In the FIG. 4 embodiment, the only difference between it and the FIG. 3 embodiment is in the particular manner the perforations cooperate with the passageway, therefore the same reference numerals will be used for components thereof common to that of the FIG. 3 embodiment. In the FIG. 4 embodiment, the first perforation 48 is essentially a continuation of the second leg 44 of the V-shaped offset portion 42 of the passageway 19, while the second perforation 49 is substantially a linear continuation of the first leg 43.

In the FIG. 5 embodiment, again the only difference between it and the FIG. 3 embodiment is in the exact configuration of the perforations. Therefore, the same reference numerals are used in FIG. 5 as for FIG. 3, for common elements. In this embodiment, only a single perforation is provided, this comprising the perforation 50 which is a generally linear continuation of the second leg 44 of the V-shaped offset portion of passageway 19.

Figure 6:
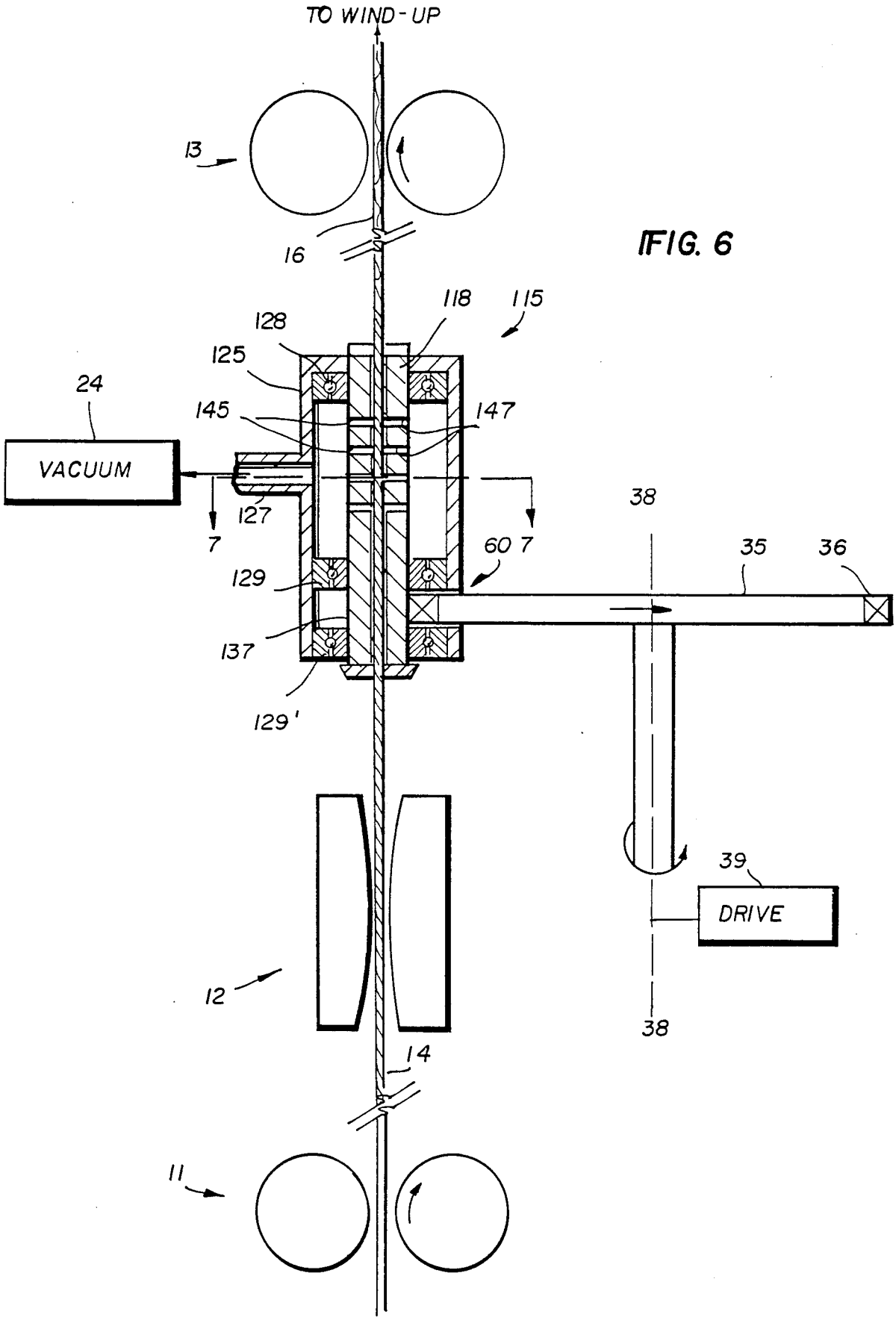
FIG. 6 is a view like that of FIG. 1 only showing a further form of spindle associated with the apparatus.

FIGS. 6 and 7 show yet another embodiment of the spindle assembly according to the present invention. In FIGS. 6 and 7, structures identical to those in the FIGS. 1 through 3 embodiment are indicated by the identical reference numeral, whereas structures comparable, but not identical to, those in the FIGS. 1 through 3 embodiment are indicated by the same reference numeral only preceded by a "1".

In FIGS. 6 and 7, the cylinder 118 is shown as having a plurality of rows of perforations spaced circumferentially therearound. For example, the row of vertically spaced perforations 145 are circumferentially spaced about 90° from a second row of perforations 146, which in turn are spaced about 90° from the third row of perforations 147, which in turn are spaced about 90° from the fourth row of perforations 148. All the perforations communicate with a completely linear through-extending axial passageway 19, with the tube 125 providing connection, through connector 127, to the source of vacuum 24. In this embodiment, the friction disc 35 penetrates the exterior surface of the tube 125 at 60, and engages a surface portion 137 thereof. Bearings 129, 129' are disposed above and below the surface 137.

In the practice of the method of texturizing yarn according to the present invention, utilizing the apparatus of any of the embodiments, the cylinder 18, 118 imparts twist to the yarn, which twist is backed up to the heater block 12 wherein the twist is set in a semi-permanent, false twist configuration. When the yarn 16 is removed from the cylinder 18 by output means 13, the twist relieves itself, and the textured, bulk, stretch-type yarn is produced. Twist is imparted to the yarn in the cylinder 18, 118 by rotating the cylinder at high speed (e.g., several hundred thousand rpm) while applying vacuum (e.g., in the range of about 8–12 inches of mercury) to the exterior of the cylinder 18, 118 so that the yarn is held by the force of the vacuum against the inner wall of the cylinder passageway 19, and thus the rotation of the cylinder 18, 118 imparts twist to the yarn.

The yarn 14 may be single filament, or may have two, three or more filaments, and positive twist control is provided. Despite the fact that positive twist control is provided, the spindle assembly 15, 115 actually exerts a gentle action on the yarn. Because of the gentle nature of the action, weaker thermoplastic filaments and/or fine denier filaments (e.g., Arnel) may be processed according to the invention, although it is not possible to process such filaments to produce textured yarn utilizing conventional pin twisting and friction twisting techniques. Thus a new textured yarn composed of weak thermoplastic filament and/or fine denier filament textured yarn is produced according to the invention.

It will thus be seen that according to the present invention a method and apparatus are provided for producing textured, bulk, stretch-type yarn with positive twist control, and with a gentle action on the yarn, and that a new type of textured yarn is produced.

While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures, methods, and products.

What is claimed is:

1. Yarn texturizing apparatus comprising:
feed means for feeding yarn to be texturized;
a heater block;
a spindle comprising a perforated cylinder having a generally axially through-extending passageway;
means for mounting said spindle for rotation about an axis generally coincident with said axial passageway;
means for rotating said cylinder about said axis;
means for applying a vacuum to the exterior of said perforated cylinder such that the yarn is held by the vacuum against an inner wall of the cylinder passageway;
output means from said cylinder for withdrawing texturized yarn from said cylinder;
said feed means, heater block, and spindle mounted with respect to each other so that during operation feed yarn passes through said feed means to said heater block, and then to said spindle, and finally to said output means.

2. Apparatus as recited in claim 1 wherein said heater has a through-extending generally linear passageway therein, said heater passageway being in-line with said cylinder passageway.

3. Apparatus as recited in claim 2 wherein said cylinder comprises a plurality of perforations formed in rows which are generally parallel to the axis of rotation of said cylinder and spaced from each other along the axis, a plurality of said rows being disposed around the circumference of said cylinder and operatively connected to said through-extending passageway.

4. Apparatus as recited in claim 1 wherein said mounting means and said means for connecting said vacuum to the exterior of said perforated cylinder comprises a generally tubular housing surrounding said cylinder and having an interior wall spaced from said cylinder, and having a connecting tube extending therefrom to said source of vacuum; and bearing means acting between said mounting tube internal walls and the exterior of said cylinder for allowing rotation of said cylinder with respect to said tube.

5. Apparatus as recited in claim 1 wherein said means for rotating said cylinder comprises a friction disc in spring or clutch contact with said spindle, and a power source for rotating said spindle disc about an axis parallel to the axis of rotation of said spindle.

6. Yarn texturizing apparatus comprising:
feed means for feeding yarn to be texturized;
a heater block;
a spindle comprising a perforated cylinder having a generally axially through-extending passageway;
means for mounting said spindle for rotation about an axis generally coincident with said axial passageway;
means for rotating said cylinder about said axis;
a source of vacuum;
means for connecting said source of vacuum to the exterior of said perforated cylinder;
output means from said cylinder for withdrawing texturized yarn from said cylinder;
said feed means, heater block, and spindle mounted with respect to each other so that during operation feed yarn passes through said feed means to said heater block, and then to said spindle, and finally to said output means, wherein said heater has a through-extending generally linear passageway therein, said heater passageway being in-line with said cylinder passageway; and
said spindle passageway having a generally V-shaped offset portion thereof, and wherein perforations of said cylinder are operatively connected to said V-shaped offset portion.

7. Yarn texturizing apparatus comprising:
feed means for feeding yarn to be texturized;
a heater block;
a spindle comprising a perforated cylinder having a generally axially through-extending passageway;
means for mounting said spindle for rotation about an axis generally coincident with said axial passageway;
means for rotating said cylinder about said axis;
a source of vacuum;
means for connecting said source of vacuum to the exterior of said perforated cylinder;
output means from said cylinder for withdrawing texturized yarn from said cylinder; and
said feed means, heater block, and spindle mounted with respect to each other so that during operation feed yarn passes through said feed means to said heater block, and then to said spindle, and finally to said output means;
said mounting means and said means for connecting said vacuum to the exterior of said perforated cylinder comprising a generally tubular housing surrounding said cylinder and having an interior wall spaced from said cylinder, and having a connecting tube extending therefrom to said source of vacuum; and bearing means acting between said mounting tube internal walls and the exterior of said cylinder for allowing rotation of said cylinder with respect to said tube; and
said spindle comprising a radially extending flange disposed adjacent the end thereof closest to said heater block, said flange abutting said bearing means and defining a lowermost portion of said mounting tube.

8. Yarn texturizing apparatus comprising:
feed means for feeding yarn to be texturized;
a heater block;
a spindle comprising a perforated cylinder having a generally axially through-extending passageway;
means for mounting said spindle for rotation about an axis generally coincident with said axial passageway;
means for rotating said cylinder about said axis;
a source of vacuum;
means for connecting said source of vacuum to the exterior of said perforated cylinder;
output means from said cylinder for withdrawing texturized yarn from said cylinder;
said feed means, heater block, and spindle mounted with respect to each other so that during operation feed yarn passes through said feed means to said heater block, and then to said spindle, and finally to said output means, and said cylinder having a first end thereof closest to said heater block, and a second end thereof most remote from said heater block, and said passageway at said first end thereof being generally circular in cross-section and having a diameter of approximately equal to twice the diameter of a single filament or the composite diameter of a multi-filament yarn fed thereto; and said passageway at said second end of said cylinder having a diameter approximately 1.5 times the diameter of a single filament texturized yarn, or composite diameter of a multi-filament texturized yarn, passing therethrough.

9. A method of texturizing a yarn utilizing a heater block, a spindle comprising a perforated cylinder with a generally axially through-extending passageway, and a source of vacuum, comprising the steps of:

(a) feeding yarn to be texturized through the heater block, in operative contact therewith, to the perforated cylinder generally axially extending passageway;

(b) imparting twist to the yarn in the cylinder, which twist is backed up to the heater block wherein the twist is set in a semi-permanent, false twist configuration; and (c) removing the yarn from the cylinder at which time the twist relieves itself and a textured, bulk, stretch-type yarn is produced; and wherein step (b) is practiced by rotating the spindle while applying vacuum to the exterior thereof so that the yarn is held by the force of the vacuum against the inner wall of the cylinder, and the rotation thereof imparts twist to the yarn; and by providing an inlet to the cylinder passageway of generally circular cross-section, and having a diameter of approximately twice the diameter of the single filament, or a composite of the multi-filament, yarn fed thereto, and providing an outlet from the cylinder passageway having a diameter of about 1.5 times the diameter of the single filament texturized yarn, or composite diameter of the multi-filament texturized yarn, exiting therefrom.

10. Apparatus as recited in claim 6 wherein said perforations operatively connected to said V-shaped offset portion of said passageway comprise a first perforation extending from a first leg of the V to one side of the cylinder, and a second perforation extending from the other leg of the V to the opposite side of the cylinder from the first perforation.

11. Apparatus as recited in claim 6 wherein said perforations operatively connected to said V-shaped portion of said passageway comprise a first perforation which is substantially a linear continuation of one leg of said V, and a second perforation which is a substantial linear continuation of the other leg of said V.

12. Apparatus as recited in claim 6 wherein said cylinder comprises a single perforation which is substantially a linear continuation of one leg of said V-shaped portion of said passageway, and slants downwardly toward the end of said spindle closest to said heater block.

13. A method of texturizing a yarn utilizing a heater block, a spindle comprising a perforated cylinder with a generally axially through-extending passageway, and a source of vacuum, comprising the steps of:

(a) feeding yarn to be texturized through the heater block, in operative contact therewith, to the perforated cylinder generally axially extending passageway;

(b) imparting twist to the yarn in the cylinder, which twist is backed up to the heater block wherein the twist is set in a semi-permanent, false twist configuration; and (c) removing the yarn from the cylinder at which time the twist relieves itself and a textured, bulk, stretch-type yarn is produced; and wherein step (b) is practiced by rotating the spindle while applying vacuum to the exterior thereof so that the yarn is held by the force of the vacuum against the inner wall of the cylinder, and the rotation thereof imparts twist to the yarn.

14. A method as recited in claim 13 wherein step (b) is practiced by rotating the spindle at a speed of several hundred thousand revolutions per minute.

15. A method as recited in claim 14 wherein step (b) is further practiced by applying a vacuum in the range of about 8–12 inches of mercury to the exterior of the cylinder.

16. A method as recited in claim 13 wherein the yarn to be texturized is a single filament or multi-filament yarn having a fine denier, the denier being so fine that the yarn is not capable of being texturized by conventional pin twisting and friction twisting texturizing processes.

17. A method as recited in claim 13 wherein the yarn to be texturized is a single filament or multi-filament yarn of weak thermoplastic filament, the thermoplastic filaments being so weak that they are not capable of being effectively texturized using pin twisting and friction twisting conventional processes.

* * * * *